US006044599A

United States Patent [19]

Wachenfeld

[11] Patent Number: 6,044,599

[45] Date of Patent: Apr. 4, 2000

[54] SPIRAL STAIRCASE

[76] Inventor: Walter Wachenfeld, Am Steinbruch 10, Volkmarsen-Külte, Germany, D-34471

[21] Appl. No.: 08/905,555

[22] Filed: Aug. 4, 1997

Related U.S. Application Data

[63] Continuation of application No. PCT/DE95/00531, Apr. 15, 1995.

[51] Int. Cl.[7] ..... E04F 11/032; E04F 11/116

[52] U.S. Cl. ..... 52/187; 52/182; 403/299; 403/307

[58] Field of Search ..... 52/182, 183, 187, 52/188, 189, 223.6, 223.14, 720.2, 736.2; 403/299, 307

[56] References Cited

U.S. PATENT DOCUMENTS

| | | | |
|---|---|---|---|
| 1,446,454 | 2/1923 | Fischer | 52/187 |
| 3,740,906 | 6/1973 | Schneider | 52/187 X |
| 4,003,450 | 1/1977 | Lohl | 52/189 X |

FOREIGN PATENT DOCUMENTS

| | | | |
|---|---|---|---|
| 18692 | 12/1904 | Austria | 52/187 |
| 2268919 | 11/1975 | France . | |
| 2317442 | 2/1977 | France . | |
| 2519051 | 7/1983 | France | 52/182 |
| 2528893 | 12/1983 | France | 52/182 |
| 1183660 | 12/1964 | Germany | 52/189 |
| 2017012 | 10/1971 | Germany | 52/189 |
| 2505476 | 8/1976 | Germany | 52/182 |
| 58-93123 | 6/1983 | Japan . | |
| 6-57899 | 3/1994 | Japan | 52/188 |
| 582810 | 12/1976 | Switzerland | 52/182 |
| 632798 | 10/1982 | Switzerland | 52/182 |
| 348229 | 5/1931 | United Kingdom | 52/182 |

OTHER PUBLICATIONS

"Dowel Bar Replacement", Dayton Superior, 12 pages, 1983.

*Primary Examiner*—Laura A. Callo
*Attorney, Agent, or Firm*—Thomas R. Vigil

[57] ABSTRACT

The circular staircase has individual steps made of stone, and in particular natural stone, mounted on a central newel. The steps each have a reinforcing member with one end that is joined to the newel and he other end that has a prestressing element against a step.

11 Claims, 3 Drawing Sheets

SPIRAL STAIRCASE

This is a continuing application of International Application No. PCT/DE 95/00531 filed Apr. 15, 1995.

BACKGROUND OF THE INVENTION

1. Field of the Invention

The invention relates to a spiral staircase with individual steps made of stone, in particular natural stone, arranged on the newel, wherein the step has a reinforcing element.

2. Description of the Prior Art

Many types of spiral staircases are known. For example, from U.S. Pat. No. 1,446,454, a spiral staircase is known wherein the stone steps rest on steel troughs or steel brackets and the steel troughs or steel brackets are connected to the newel. The making of such a spiral staircase with steel troughs or steel brackets is complicated as the steel troughs and brackets must be made separately. The same also applied to spiral staircases with a steel string-board on the outside radius and often also on the inside radius of the spiral stairs, in which case the steel troughs are welded on the inside and outside to the steel string-boards. These constructions require a lot of space and because of complicated welding work are also expensive. Such spiral staircases also always appear extremely heavy.

In addition, from the FR-A 23 17442 a stairs is known, with which the individual steps are set, freely protruding, into the wall, in which case the steps are nevertheless connected to one another by bolts. The steps acquire the required carrying capacity by reinforcing bars that lie in the steps, to which also the bolts are attached which connect the individual steps to one another.

Furthermore, spiral staircases are known, with which the step consists of two horizontally split layers, wherein a reinforcing of fibreglass fabric is glued in between the two layers and wherein the individual steps rest on top of one another by way of bolts.

With these spiral staircases an extraordinary exact manufacture of the individual steps and an accurate installation of the steps is required, as on the one hand no horizontal gap may occur between the individual steps and on the other hand it must be ensured that the last top step rests directly against the end face of the opening in the ceiling.

These spiral staircases are limited to an outside diameter of 200 cm. Furthermore, such staircases can hardly be used outside as due to the effect of frost the risk exists that the two stone layers may come apart in the area of the fiberglass fabric.

SUMMARY OF THE INVENTION

It is, therefore, the object of the invention to create a spiral staircase which permits a simple manufacture and installation.

According to the invention the object is achieved by a spiral staircase with freely protruding steps made of natural stone arranged on the newel and not connected to one another, wherein each step has a reinforcing element, wherein the reinforcing element at its one end can be connected to the newel and at its other end can be prestressed relative to the step by means of a tensioning element. In other words, the preferably rod-shaped reinforcing element extends through the step along its length and is put under tension by the tensioning element, wherein the step itself is placed under a corresponding compressive stress. When a load is now placed on the step, because of the bending stress of the step, the compressive stress of the step is reduced corresponding to the mass standing on the step.

A spiral staircase constructed in this manner can be installed up to an outside diameter of 400 cm, inside as well as outside. Especially when the staircase is installed outside, it is expedient to make the metal parts of stainless steel and to select a weather-resistant material, e.g. granite, for the steps.

In detail it is provided that the tensioning element consists of a sleeve with an outwards projecting continuous collar, wherein the sleeve can be connected to the rod-shaped reinforcing element and wherein the continuous collar rests against the end face of the step. This sleeve has a continuous internal thread, the reinforcing element being provided with an external thread corresponding to the internal thread of the sleeve.

By simply turning the sleeve onto the screw thread of the rod-shaped reinforcing element , the prestress can therefore be applied to the step.

It has been found, in particular that an increase in the load to be absorbed by the step can be obtained when the reinforcing element is arranged in the upper third of the cross section of the step. In that case the spiral staircases can have an outside diameter of up to 400 cm.

According to a further feature of the intention it is proved that a bolt to accommodate the supports of a staircase railing can be put into the sleeve from the outside. Because the sleeve has a continuous internal thread, a bolt with a corresponding external thread, which holds the support of the staircase railing, can be turned into it. An advantage of this is that the utilisation of the step across its width is increased, so that the steps can be made narrower. According to the state of the art the situation is such that with finished staircases the supports of the railing are fastened into the steps from the top, so that part of the width of the step is lost.

To facilitate the installation of a spiral staircase, it is proved that the newel comprises on its circumference a shackle, in particular of steel, wherein the reinforcing element can be connected to this steel shackle, e.g. by welding. The shackle itself is connected to the newel by a screw connection. As every step has a shackle, the installation is relatively simple in so far that after erecting the newel, only he individual shackles with the steps attached thereto need still be fastened to the newel.

The installation of the newel can be facilitated further when the newel consists of individual elements which can be plugged into one another.

In the following the invention will be explained in grater detail with reference to the drawings, wherein:

DESCRIPTION OF THE PREFERRED EMBODIMENT(S)

Figure 1:
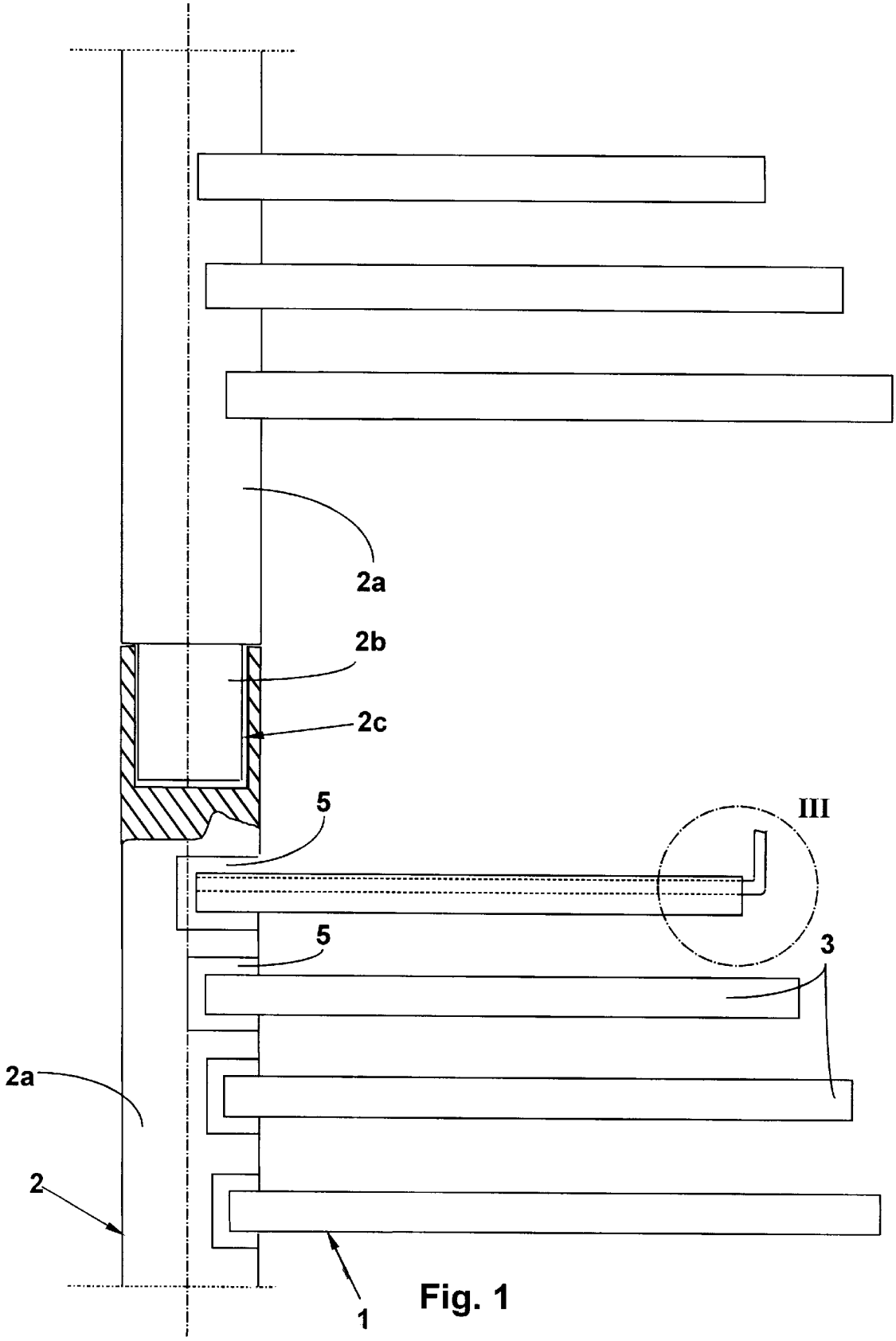
FIG. 1 shows a view of the cut-out of a spiral staircase.

According to FIG. 1 the spiral staircase with the general reference numeral 1 consists of the newel 2 and individual steps 3 arranged on the newel 2. The newel 2 consists of newel elements 2*a*, every newel element 2*a* being provided at its one end with a trunnion 2*b* which is held in a correspondingly shaped opening 2*c* in he other newel element. In other words, the individual newel elements can by joined together by plugging them into one another. Up to an outside diameter of 300 cm of the spiral staircase, the newel may consist of one single part.

Figure 2:
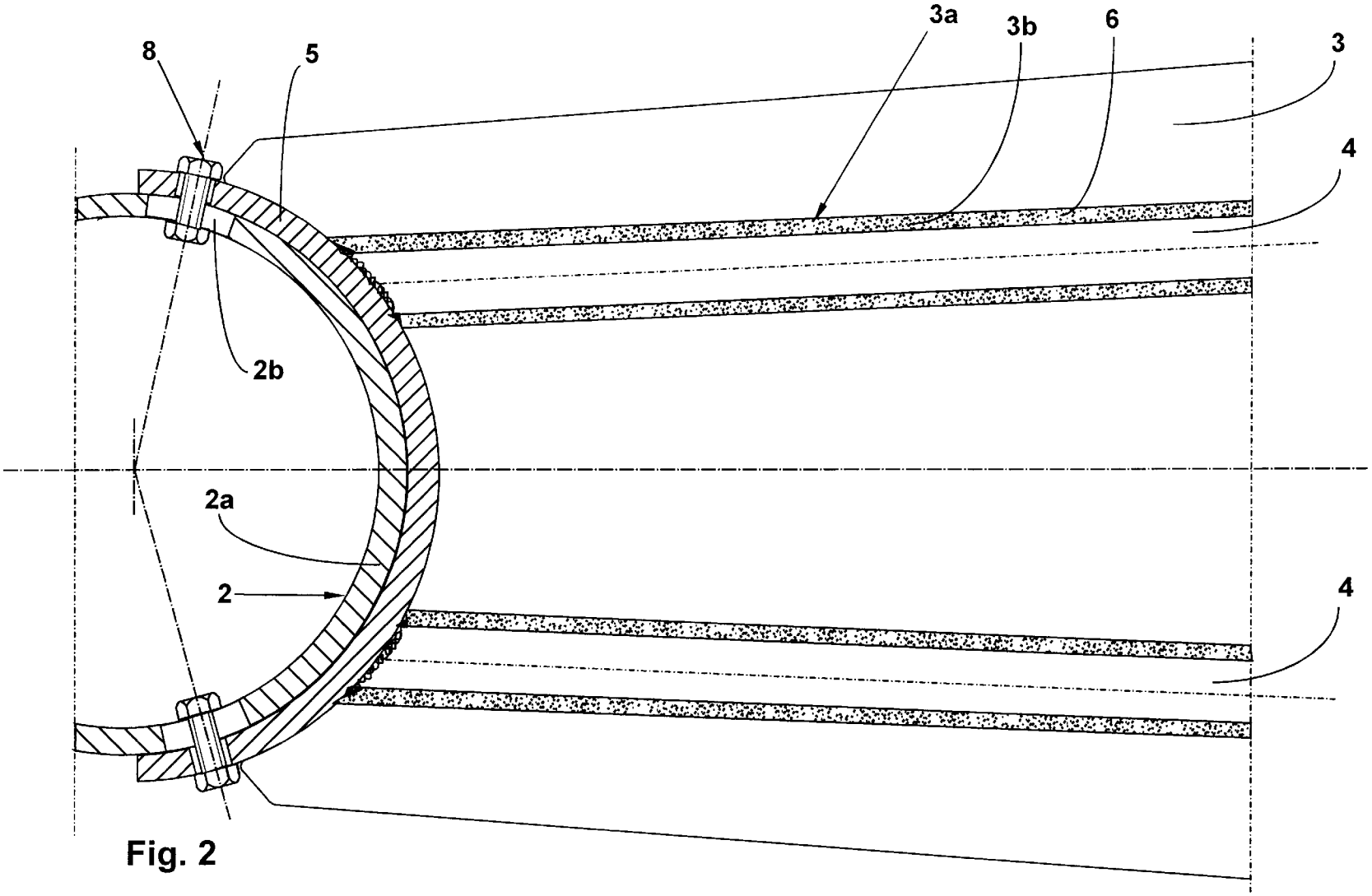
FIG. 2 shows a section along the line 2—2 of FIG. 1.
Figure 3:
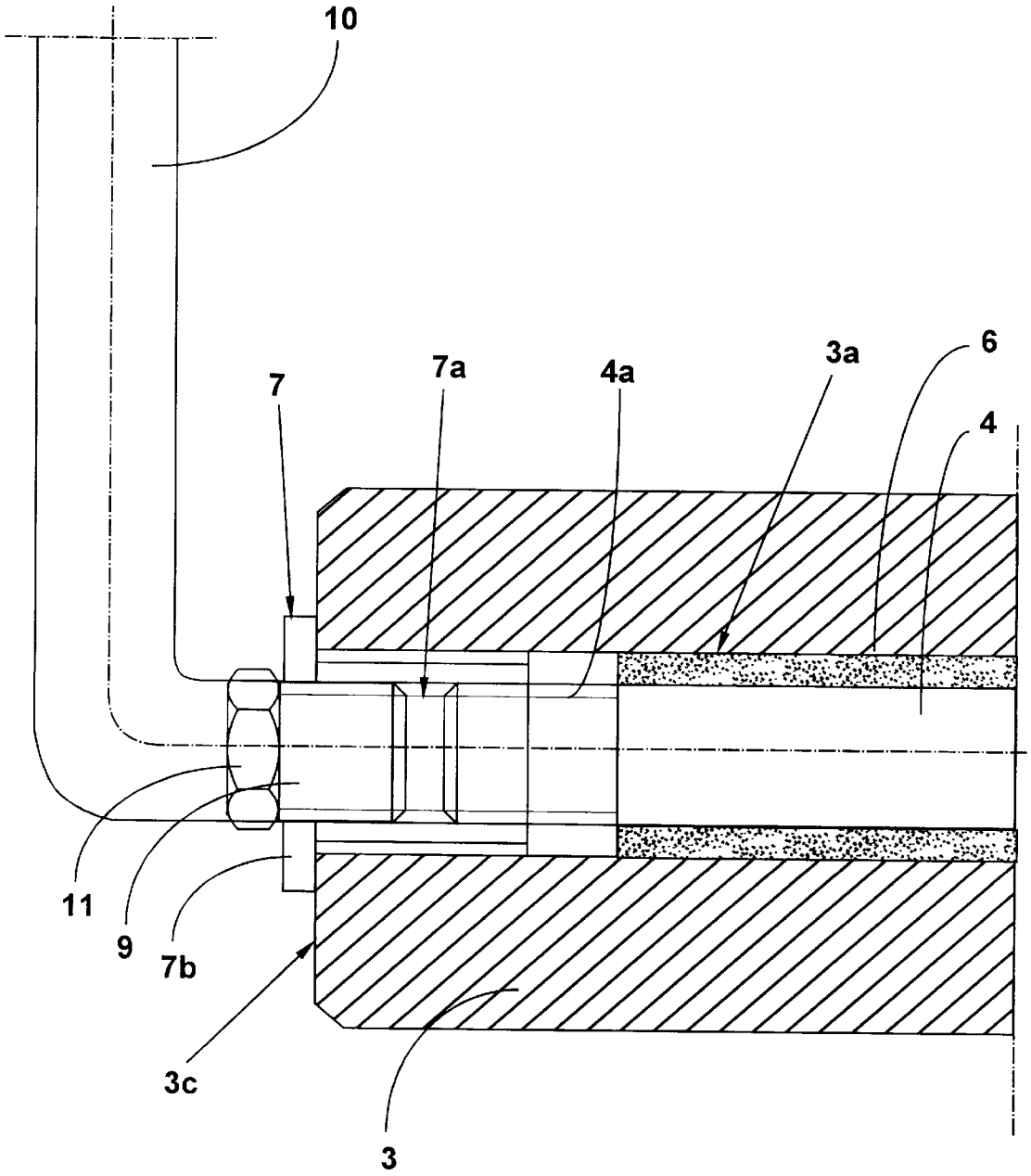
FIG. 3 shows the detail "X" on a larger scale.

The construction and method of fastening a step 3 to the newel can be noted from FIG. 2 and 3.

The step 3 has two steel rod-shaped reinforcing elements 4 which extend horizontally through the step and on the side of the newel are welded to the shackle 5. The bores 3*a* to hold the rod-shaped reinforcing element 4 have a larger diameter than the diameter of a rod-shaped reinforcing element 4, so that there is a cavity 3*b* between the reinforcing element 4 and the bore 3*a*, which can be filled with mortar 6. To now place the step 3 under compressive stress, the sleeve 7 is turned onto the rod-shaped reinforcing element 4. To this end the sleeve 7 has an internal thread 7*a* and the rod-shaped reinforcing element 4 has a corresponding external thread 4*a*. In addition, he sleeve 7 has an outwards projecting collar 7*b* which, after the rod-shaped reinforcing element 4 has been screwed on, rests against the end face 3*c* of the step 3. Depending on the force with which the sleeve 7 is turned onto the rod-shaped reinforcing element 4, the compressive stress acting on the step 3 is increased or reduced. In other words, the compressive stress of the step is in direct relation to the tensile stress of the rod-shaped reinforcing element 4.

To fasten he shackle 5 to the newel element 2*a* of the newel 2, the newel element has suitable slots 2*d* through which screw bolts 8 extend, which in turn are connected to the shackle 5. The provision of slots in the newel elements 2*a* has the advantage that this facilitates the aligning of the step in relation to its distance from the adjoining step. To put the screws in the slot, a log spatuler is provided with which the screw is guided through the inside of the newel up to the slot and is held there.

To fasten the staircase railing, a bolt 9 to hold the support 10 of he railing can be screwed into the internal thread 7*a* of the sleeve 7. To fix the bolt 9 in the internal thread 7*a* of the sleeve 7, the nut 11 is provided, which can be tightened against the continuous collar 7*b* of the sleeve 7.

I claim:

1. Spiral staircase comprising individual steps (3) made of stone which are arranged on and relative to a newel (2) and arranged to protrude freely from the newel (2), each step (3) having an elongate reinforcing element (4) extending along the length of each step and each reinforcing element (4) being connected at one end to the newel (2); a tensioning element (7) mounted on the other end of the reinforcing element (4) tensioning the reinforcing element (4) and applying pressure against the stone step (3) with which it is associated; and adjacent said steps not being connected to one another and being connected to the newel (2) in a freely protruding manner.

2. Spiral staircase according to claim 1, characterised in that the reinforcing element is rod-shaped and extends through the step along its length.

3. Spiral staircase according to claim 2, wherein the tensioning element comprises a sleeve with an outwardly projecting continuous collar, wherein the sleeve is connected to the rod-shaped reinforcing element and wherein the continuous collar rests against the end face of the step.

4. Spiral staircase according to claim 3, characterised in that the sleeve has an internal thread.

5. Spiral staircase according to claim 4, characterised in that the rod-shaped reinforcing element has an external thread corresponding to the internal thread of the sleeve.

6. Spiral staircase according to claim 4 including a bolt to accommodate the support of a staircase railing, said bolt being put into the sleeve from the outside.

7. Spiral staircase according to claim 2 wherein the reinforcing element is arranged in the upper third of the cross-section of the step.

8. Spiral staircase according to claim 1 characterised in that the reinforcing element is arranged in the upper third of the cross-section of the step.

9. Spiral staircase according to claim 1 wherein the newel has a shackle and wherein the reinforcing element is connected to the shackle.

10. Spiral staircase according to claim 9 wherein every step has one said shackle.

11. Spiral staircase according to claim 1 wherein the newel comprises individual elements which are joined together by plugging them into one another.

* * * * *